United States Patent [19]

Yoshioka et al.

[11] Patent Number: 4,459,164

[45] Date of Patent: Jul. 10, 1984

[54] METHOD AND APPARATUS FOR COMPENSATING FOR AXIAL DEFORMATION OF SCREW SHAFTS DUE TO HEAT TREATMENT

[75] Inventors: Morihisa Yoshioka, Hamamatsu; Fumikazu Goto, Iwata, both of Japan

[73] Assignee: NTN Toyo Bearing Company, Limited, Osaka, Japan

[21] Appl. No.: 451,390

[22] Filed: Dec. 20, 1982

[30] Foreign Application Priority Data

Dec. 29, 1981 [JP] Japan ..... 56-212946

[51] Int. Cl.[3] ..... C21D 8/00

[52] U.S. Cl. ..... 148/128; 148/12 B; 148/130; 148/150; 266/115; 266/129

[58] Field of Search ..... 148/11.5 R, 12 R, 12 B, 148/12.4, 128, 129, 130, 131, 150, 153; 266/129, 115

[56] References Cited

U.S. PATENT DOCUMENTS 3,488,236 1/1970 Husen, Jr. ..... 148/150

FOREIGN PATENT DOCUMENTS 154780 4/1982 Fed. Rep. of Germany ..... 148/147
57-181327 11/1982 Japan ..... 148/131
341843 7/1972 U.S.S.R. ..... 266/129
711127 7/1980 U.S.S.R. ..... 148/12 B
840156 6/1981 U.S.S.R. ..... 148/130

*Primary Examiner*—Peter K. Skiff
*Attorney, Agent, or Firm*—Armstrong, Nikaido, Marmelstein & Kubovcik

[57] ABSTRACT

A method and apparatus for compensating for axial deformation of screw shafts due to heat treatment, wherein in the process of hardening of a screw shaft, the screw shaft is twisted to produce permanent twist deformation by an amount corresponding to the pitch error of the screw shaft caused by hardening, so as to correct the pitch error.

5 Claims, 9 Drawing Figures

FIG. 6
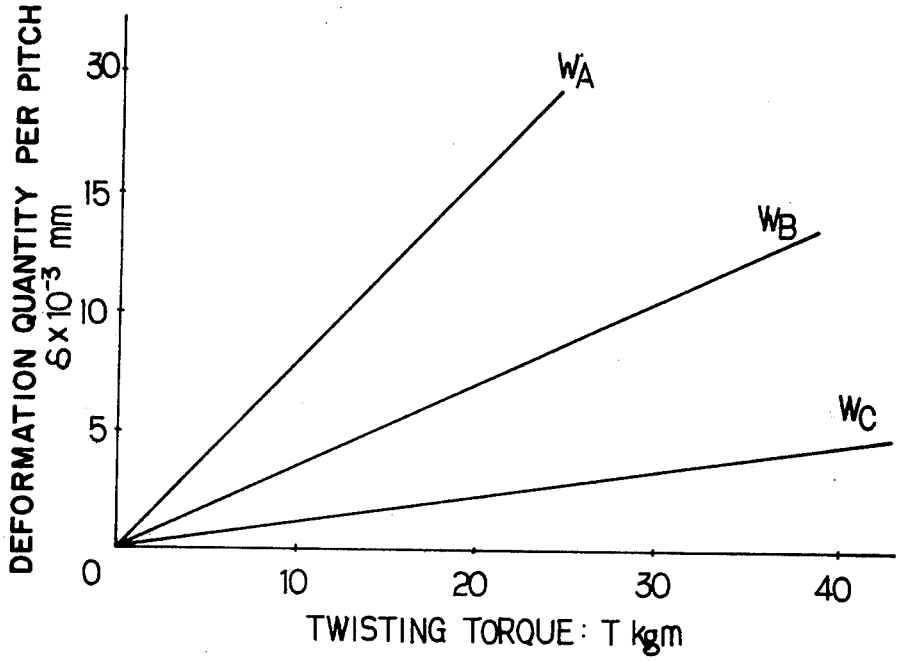
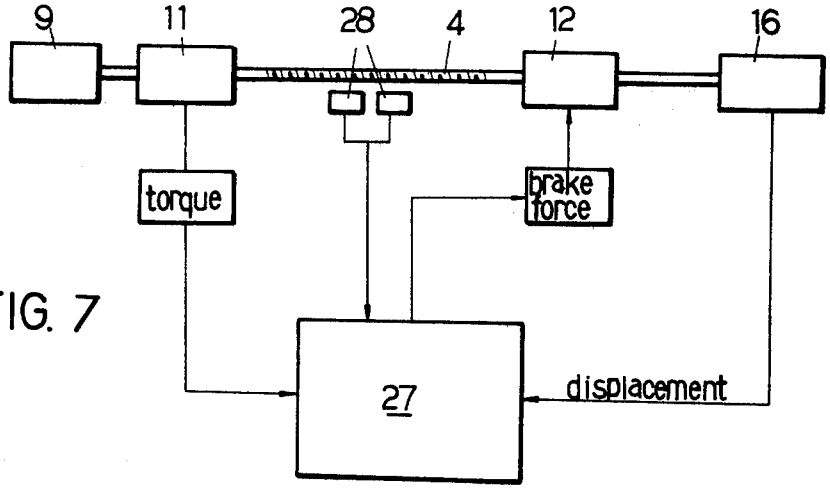
FIG. 7

METHOD AND APPARATUS FOR COMPENSATING FOR AXIAL DEFORMATION OF SCREW SHAFTS DUE TO HEAT TREATMENT

This invention relates to a method and apparatus for compensating for axial deformation of screw shafts due to heat treatment, wherein the pitch error of a screw shaft caused by phase transformation, structural change, internal stress, external force, etc., encountered during hardening of the screw shaft is corrected in the process of hardening.

A screw shaft of which a predetermined hardness and dimensional accuracy are required, e.g., a ball screw as a feed screw used in measuring machines and machine tools forms a rolling pair similar to that found in an angular contact ball bearing, and its raceway surface is refined by being subjected to the necessary kinds of heat treatments (carburizing, high frequency hardening and other hardening treatments and tempering) after formation of a screw groove with predetermined accuracy on a lathe, in order to increase the rolling life and reduce frictional resistance. Then, the ball screw is finished by grinding with high accuracy, i.e., a single pitch error of $3\mu$ or less and a cumulative pitch error of $20\mu/300$ mm.

Generally, metal materials undergo phase transformation and structural change during heat treatment, which, combined with external force and thermal stress produced in the material by heating and cooling, cause changes in size and shape. The amounts of these changes vary according to the material composition, heat treatment history, and heat treatment conditions. In the case of a screw shaft, such a change appears as a pitch error, adversely affecting the subsequent grinding process. That is, in the grinding process, the screw shaft is fed relative to the grinding wheel and in synchronism with the rotational drive. But if the screw shaft continues in the axial direction owing to heat treatment, the pitch of the screw grooves formed with accuracy predetermined by allowing for an expected amount of axial deformation due to heat treatment becomes inconsistent and fails to conform to the grinding pitch determined by the grinding conditions. As a result, only one side of the working surface of the grinding wheel cuts deep into the flank of thread, which might well lead to undue grinding wheel wear while the other side fails to grind the flank sufficiently, resulting in an uncut portion leftover. Undue wear of the grinding wheel will make accurate finish impossible since the grinding wheel shape should be reproduced on the flank.

Now, the pitch error resulting from heat treatment is greater during hardening than during annealing, and its variation is relatively small during annealing. The amount of axial deformation so referred to hereinafter, i.e., axial expansion or contraction, is also relatively stabilized during annealing, but during hardening the amount greatly varies owing to delicate changes in the hardening conditions. It is found that the tendency of axial deformation does not come to be fixed. For this reason, the pitch error which takes place during annealing can be tolerated and dealt with. For example, it is possible to assign, allowing for a pitch error produced during annealing, a greater or smaller value to the pitch of threads to be cut in a screw shaft on a lathe in the preparatory process so as to ensure that the predetermined pitch will result when annealing has been completed.

The pitch error which will take place during hardening, however, cannot be dealt with satisfactorily by the aforesaid method. Therefore, in producing screws, such as ball screws, of which predetermined hardness and dimensional accuracy are required, it has been common practice to severely set heat treating conditions which are less liable to produce dimensional changes during hardening, or to provide a greater grinding allowance for grinding process or to effect frequent reshaping (truing or dressing) of the grinding wheel, so as to secure the predetermined threading accuracy. These measures, however, lower the efficiency of processing the screw shaft.

In view of the above described production steps and requirements and conventional problems, this invention contemplates compensating for the pitch error produced during hardening treatment by twisting a screw shaft to have a permanent torsional deformation corresponding to the pitch error to be corrected. Attention is paid to the fact that twisting a screw shaft brings about a change in the helix of the threads and a consequent change in the pitch of the threads. This is based on the property of metal materials that in the course of hardening treatment, i.e., during and on completion of heating to an elevated temperature determined according to the metal material and during cooling from that temperature, the metal material will readily plastically deform (permanent torsional deformation in this case). In other words, with attention paid to the property of metals that at a certain temperature a metal decreases in elasticity limit, and creeps or readily exhibits plastic deformations including such behavior as is called superplasticity; the invention utilizes the property of steel that it readily exhibits plastic deformation during hardening.

Thus according to the invention, in the course of phase transformation during or on completion of heating to an elevated temperature for hardening or cooling from that temperature, the screw shaft is twisted by an amount corresponding to the pitch error produced during hardening so that permanent torsional deformation is given to the screw shaft, thereby compensating for axial deformation due to hardening. According to this invention, since the relatively large error of pitch of the screw shaft produced during hardening can be easily corrected with high accuracy, it is possible to reduce the allowance for grinding subsequent to heat treatment to thereby shorten the time required for grinding. Since this correction is made during hardening, there is no possibility of decreasing productivity and the torque for twisting the screw shaft can be set to a small value.

Further, since in correcting the amount of axial deformation it is only necessary to twist the screw shaft without pulling or compressing it, there is no danger of causing buckling. Since the shaft end portion is only twisted through an angle corresponding to the amount of correction of axial deformation, a uniform correction can be made throughout the length of the screw shaft.

These and other objects and features of this invention will become more apparent from the following description to be given with reference to the accompanying drawings, in which:

FIG. 6 is a graph showing the relation between the deformation quantity per pitch (p=20 mm) of the threads of a screw shaft and drive conditions for loading the screw shaft;

FIG. 7 is a block diagram of an apparatus for making a correction by giving beforehand a screw shaft a drive torque which produces an angle of torsion corresponding to a target correction quantity;

Figure 1:
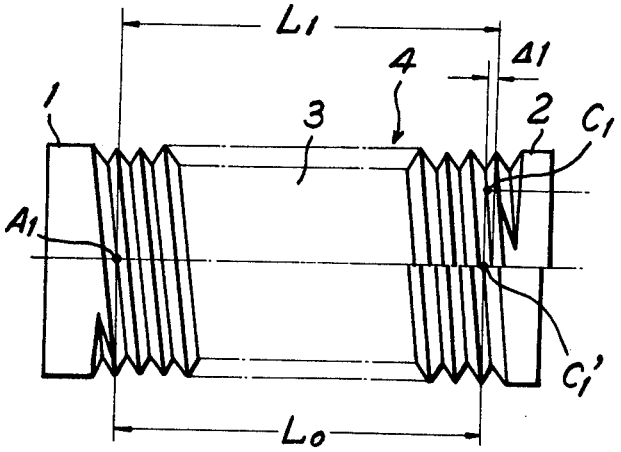
FIGS. 1 and 3 show screw shafts to be corrected, showing on both sides of the centerline the states before and after axial deformation.
Figure 3:
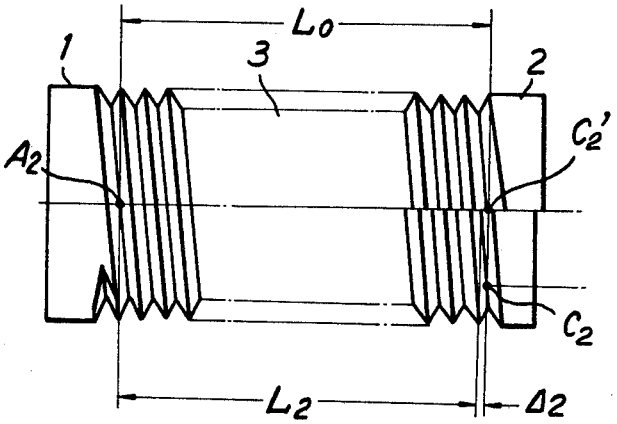

FIGS. 1 and 3 show the states of screw shafts 4 before and after they are heat-treated. That is, the figures show that the effective threaded portion 3 of the screw shaft 4 produces axial expansion or contraction $\Delta_1$, $\Delta_2$ depending upon the thermal history (quenching) during hardening, thus changing the reference length $L_0$ of the effective threaded portion to $L_1$, $L_2$. That is, it has produced a cumulative pitch error by $\Delta_1$, $\Delta_2$. And $\Delta_1$, $\Delta_2$ will be hereinafter referred to as deformation quantity.

Figure 2:
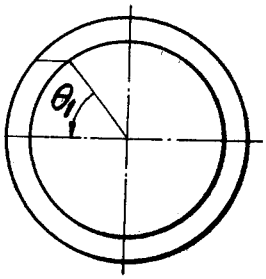
FIGS. 2 and 4 are end views of the screw shafts of FIGS. 1 and 3.
Figure 4:
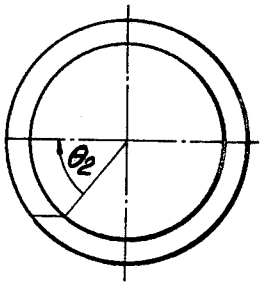

According to this invention, in the course of heating the screw shaft 4 to an elevated temperature for hardening, holding it at that temperature and cooling it, the shaft end 1 associated with a measuring point $A_1$, $A_2$ is locked to prevent rotation of the shaft and then the shaft end 2 associated with a measuring gage point $C_1$, $C_2$ is twisted. As a result, plastic deformation is produced uniformly in the effective threaded portion 3 along the circumference of a plane perpendicular to the axis of the screw shaft 4 so as to uniformly correct individual pitch error of the effective threaded portion 3. The cumulative pitch error of the effective threaded portion 3 can be easily and accurately corrected by giving the shaft end an angle of torsion which causes the point $C_1$, $C_2$ to plastically deform to a point $C_1'$, $C_2'$ along the circumference of a plane perpendicular to the axis of the shaft, i.e., through an angle of torsion $\theta_1$, $\theta_2$ corresponding to $\Delta_1$, $\Delta_2$ as shown in FIGS. 2 and 4.

Figure 5:
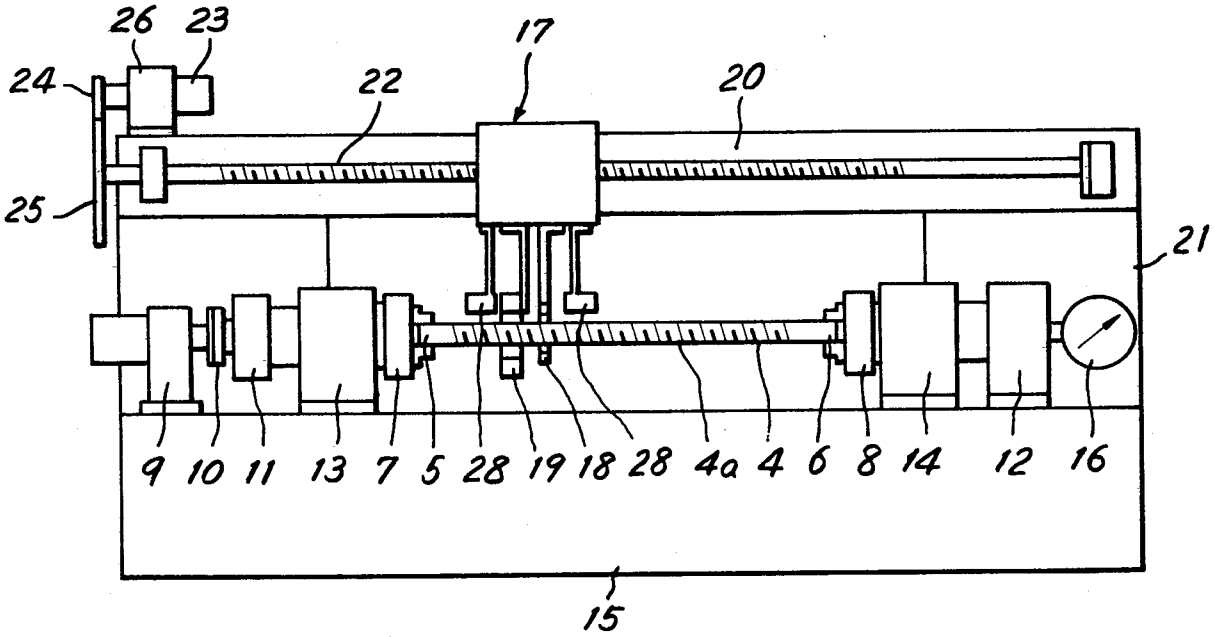
FIG. 5 is a schematic view showing an embodiment of an apparatus for carrying out the method of this invention.

FIG. 5 shows a high frequency hardening apparatus to which the invention is applied. The screw shaft 4 is supported at its ends 5 and 6 by a drive chuck 7 and a brake chuck 8 and the drive chuck 7 is driven at reduced speed by a geared motor 9. A clutch 10 and a torque detector 11 are connected between the output shaft of the geared motor 9 and the drive chuck 7. A brake device 12 for braking the rotation of the brake chuck 8 includes a brake motor adapted to change the brake torque according to the value of electric current produced, so as to adjust the twisting torque in the screw shaft 4. The numerals 13 and 14 denote bearing devices for the drive and brake chucks 7 and 8.

The geared motor 9 and bearing device 13 are fixed on the base 15 of this hardening device, while the bearing device 14 and brake device 12 are supported on a slide guide portion (not shown) formed on the base 15 and is adapted to be axially slidable according to the expansion or contraction of the screw shaft 4. In addition, if the chuck 8 is of the type fixed circumferentially of the screw shaft 4 and axially slidable, the bearing device 14 and brake device 12 may be fixed to the base 15.

A microdisplacement meter 16 is fixed at a suitable place on the base 15 in contact with the end of the screw shaft 4 directly or indirectly through the brake device 12 for measuring the amount of expansion or contraction of the screw shaft 4. It may be a dial gage or a differential transformer type displacement meter.

Projecting from the lower portion of a high frequency heating device 17 installed slidably in the direction of the axis of the screw shaft 4 are a high frequency heating coil 18 surrounding the threaded portion 4*a* of the screw shaft 4 supported by the drive and brake chucks 7 and 8, and a water spouting ring 19 adjacent the coil.

The numeral 20 denotes a slide guide member for the high frequency heating device 17 fixed to the frame 21; 22 denotes a feed screw threadedly engaged with the high frequency heating device 17; 23 denotes a drive motor for driving the feed screw through intermeshing gears 24 and 25; and 26 denotes a stepless speed change device interposed between the drive motor 23 and the gear 24 to make it possible to set the feed speed of the high frequency heating device 17 to any desired value. A detector 28 measures the temperature of the screw shaft 4 immediately befor heating and its temperature immediately after the water spouting ring has passed.

Torque T required to correct the deformation quantity $\Delta_1$, $\Delta_2$ of the screw shaft 4 by the use of the high frequency heating device, and the angle of circumferential torsion per unit axial reference length (e.g., 300 mm) in unit time will now be described.

Generally, if screw shafts of various steels and various sizes are twisted in the process of hardening, it is found that for screw shafts of the same steel and same size there is a uniform relation between the deformation quantity $\Delta_1$, $\Delta_2$ deformation quantity per pitch-$\delta$-, and rotative drive conditions for loading the screw shafts, as shown in FIG. 6. That is, it has been found that under the same hardening condition a constant proportionality relation exists between the deformation quantity per unit treatment of threads of the screw shaft, e.g., pitch of the threads of the screw shaft after hardening, and the twisting torque T for loading the screw shaft in the process of hardening, and that when the hardening conditions are changed under the same torque T, the quotient obtained by dividing the angle of circumferential torsion per unit axial reference length (e.g., 300 mm) by the time required for travelling hardening through reference length, namely, the angle $\theta$ of circumferential torsion per unit axial reference length (e.g., 300 mm) in unit time—strain rate in torsion—increases ($WA \approx 2WC$), though of the same order, with increase in heating condition, under those hardening conditions WA, WB, WC shown in FIG. 6 wherein the output of the high frequency heating device and the feed speed of the heating coil are changed, while the length of the heating region is kept constant. Therefore, with certain hardening condition selected, if the deformation quantity per pitch $\delta$ is calculated from the deformation quantity $\Delta_1$, $\Delta_2$ of the screw shaft 4 produced during hardening treatment, it is possible to uniquely determine the proper rotational drive conditions of the screw shaft 4 for correcting the deformation quantity per pitch $\delta$ under a certain heat treating condition as among those conditions WA, WB, WC as shown in FIG. 6, i.e., the torque T under certain heat treating conditions.

In correcting the deformation quantity $\Delta_1$, $\Delta_2$ on the basis of the twisting torque determined with respect to screw shafts of various steels and sizes as described above, there are two cases: case (I) where the target correction quantity is detected in advance through preparatory experiments conducted under the same heat treating conditions using screw shafts of the same kind of steel and same size, and a twisting torque T which will produce an angle of torsion $\theta_1$, $\theta_2$ corresponding thereto is given to the screw shaft, and case (II) where in the normal condition where during travelling hardening, the heating and cooling of the threaded portion are successively effected and expansion and contraction are repeated, i.e., in the condition where thermal expansion, thermal contraction, transformation expansion and transformation contraction have reached their normal states, the expansion or contraction of the screw shaft 4 is detected momently (e.g., at every unit treatment time or unit treatment pitch) and the twisting torque T calculated from this quantity is given immediately and each time to the screw shaft 4, whereby requisite feedback for correction is effected momently.

(I) The correcting operation to be effected in the case where the screw shaft 4 is given in advance the drive torque T producing the angle of torsion $\theta_1$, $\theta_2$ corresponding to the target correction quantity will be described with reference to FIG. 7.

In this case, in preparatory experiments, while the opposite ends 5, 6 of the screw shaft 4 are fixed by the brake and drive chucks 7 and 8, the screw shaft 4 will be continuously hardened along its length from the shaft end 5 toward the shaft end 6 without being loaded with drive torque T. That is, surface hardening is effected as the high frequency heating device 17 travells axially of the screw shaft 4 without loading twisting torque T, by successively heating the threaded portion 4*a* to an elevated temperature by the high frequency heating coil 18, and then by spouting a coolant such as cooling water through the water spouting ring 19.

During this while, the brake chuck 8 and the brake device 12 are axially moved owing to the expansion or contraction of the screw shaft 4. In addition, in the case where the chuck 8 is capable of gripping the screw shaft 4 while allowing it to move axially, the shaft end 6 is axially moved. Next, the deformation quantity $\Delta_1$, $\Delta_2$ with respect to the reference length $L_0$ of the screw shaft 4 is measured on the basis of the displacement of the brake device 16 established upon completion of the hardening.

The deformation quantity per pitch $\delta$ is calculated on the basis of the measured deformation quantity $\Delta_1$, $\Delta_2$. The proper rotative drive condition (i.e., twisting torque T) for correcting the deformation quantity per pitch $\delta$ is determined from the relation shown in FIG. 6 and stored in an arithmetic control section 27. This arithmetic control section 27 drives the geared motor 9 and brake device 12 under the above determined rotative drive condition and high frequency hardening is performed while loading the screw shaft 4 with the twisting torque T during mass-production.

Further, the twisting torque T actually loaded on the screw shaft 4 during mass-production is measured by the torque detector 11. The arithmetic control section 27 makes a comparison between this torque T and the rotative drive torque T set by the rotative drive condition and feeds back the calculated result to the brake device 12, so as to adjust the brake force to ensure that set rotative drive torque T is loaded on the screw shaft 4.

Figure 9:
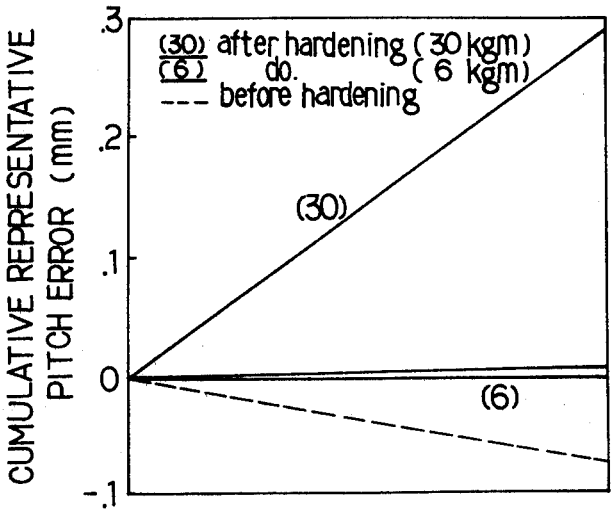
FIG. 9 is a graph showing the cumulative representative pitch error of a hardened testpiece corrected by this invention.

The result of this correction will be described with reference to FIG. 9. The horizontal axis indicates the distance from the fixed end of the screw shaft and the vertical axis indicates the cumulative presentative pitch error. In addition, the testpiece is a screw shaft having a diameter of 34 mm, a lead of 8 mm and 36 threads. It can be seen from this figure that a screw shaft having a cumulative representative pitch error of about −0.07 mm at the time of preparatory machining by lathing can be corrected to change it to about −0.01 mm by the correcting method of the present invention. Moreover, a screw shaft having even a cumulative representative pitch error of about −0.36 mm at the time of preparatory lathing can be corrected by imparting a twisting torque of 30 kg-m according to the method of the invention.

Figure 8:
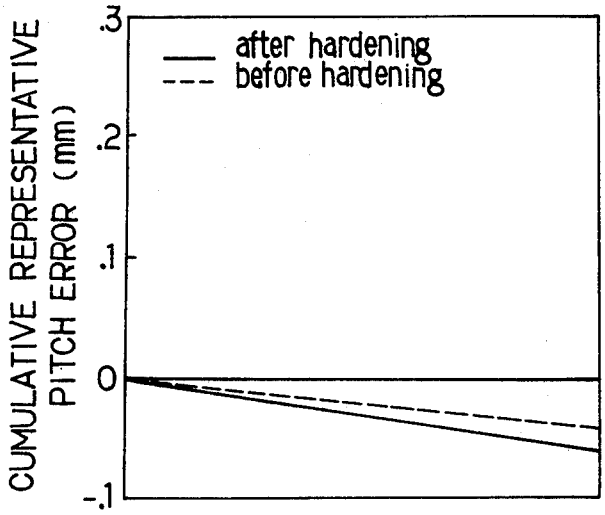
FIG. 8 is a graph showing the cumulative representative pitch error of a hardened testpiece not corrected by this invention, parenthetic indications referring to twisting torques applied.

From FIG. 8 showing a pitch error in the case of hardening under the same condition but without employing the correcting method of the invention, it can be seen that a screw shaft having a cumulative representative pitch error of about −0.04 mm at the time of preparatory lathing produces an additional amount of about 0.025 mm (providing the final cumulative representative pitch error of about −0.065 mm).

(II) A description will be given of the correcting operation in the normal state of travelling hardening where the heating and cooling of the threaded portion 4*a* are being simultaneously performed. Every time the deformation quantity of the screw shaft is detected momently (e.g., at every unit treatment time or unit treatment pitch), the drive torque T which corrects it, is fed back to the screw shaft immediately. In the normal state the screw shaft 4 partially expands where heated by the high frequency heating coil 18 and partially contracts where cooled by the cooling water from the water spouting ring 19 with cubical changes attendant to phase changes. At the same time as the hardening of the threaded portion 4*a* which is momently proceeding, the amount of deformation of the threaded portion 4*a* produced per unit treatment time or unit treatment pitch is measured by the microdisplacement meter 16 and the latent heat in the screw shaft immediately after the water spouting ring has passed is measured by the detector 28. The amount of deformation is thus converted to the value at the room temperature. The converted value is fed back, whereby a correction on the region of the threaded portion 4*a* to be subsequently hardened is made immediately and at each time.

While the above embodiment has been described with the purport of zeroing the cumulative pitch error during hardening, in the case where the cumulative pitch error which is produced during annealing can be quantitatively known, it can be corrected to a cumulative pitch error with that amount (dimension) taken into consideration. Although the description has been given of the correction of deformation of a triangular-thread screw using a high frequency hardening device, the screw shaft may be a ball screw, of course, or it may be a hydrostatic screw having rectangular threads. Further, if the hardening device is adapted to twist the screw shaft during heating, it may be a batch furnace or a continuous furnace.

What is claimed is:

1. A method of compensating for axial deformation of metal screw shafts due to heat treatment in the process of hardening, comprising heating and cooling said screw shafts to harden said screw shafts and twisting said screw shafts through an angle of torsion corresponding to the pitch error in the screw shaft due to hardening, to deform said screw shafts to correct said pitch error.

2. A method as set forth in claim 1, wherein the screw shaft is twisted through an angle of torsion corresponding to a target correction quantity predetermined through preparatory experiments conducted under the same heat treating conditions using screw shafts of the same kind of steel and same size.

3. A method as set forth in claim 1, wherein the axial deformation of the screw shaft, which is subjected to sequential heating and cooling, is detected at intervals of unit treatment time or of unit treatment pitch, and the screw shaft is twisted each time through a corresponding angle of torsion.

4. An apparatus for compensating for axial deformation of screw shafts due to heat treatment, comprising drive and brake chucks for supporting the screw shaft therebetween, said drive chuck being stationary, said brake chuck allowing axial deformation of the screw shaft;

heating and cooling means for heating and cooling the screw shaft;

bearing devices for rotatably supporting the drive and brake chucks;

a driving device for rotating the drive chuck;

a brake device for braking the brake chuck against rotation;

a torque detector for measuring the twisting torque in the screw shaft; and an arithmetic control section for comparing a twisting torque to be applied on said screw shaft for correcting the axial deformation of said screw shaft with the twisting torque on said screw shaft to adjust said brake device according to the result of that comparison.

5. An apparatus as set forth in claim 4, wherein said heating and cooling means includes a high frequency heating coil and a coolant spout ring and is effective to travel along and relatively to said screw shaft.

* * * * *